United States Patent [19]

Bäcker et al.

[11] Patent Number: 4,701,980

[45] Date of Patent: Oct. 27, 1987

[54] METHOD FOR THE MULTI-STAGE FIBRE CABLES AND THE APPARATUS REQUIRED FOR IT

[75] Inventors: Wolfgang Bäcker, Pulheim; Wolfram Wagner, Dormagen; Günther Hahn, Dormagen; Ralf Miessen, Dormagen, all of Fed. Rep. of Germany

[73] Assignee: Bayer Aktiengesellschaft, Leverkusen, Fed. Rep. of Germany

[21] Appl. No.: 847,798

[22] Filed: Apr. 3, 1986

[30] Foreign Application Priority Data

Apr. 25, 1985 [DE] Fed. Rep. of Germany ..... 3514863

[51] Int. Cl.[4] ..... D06B 21/00; D02G 1/12

[52] U.S. Cl. ..... 19/0.48; 19/151; 19/157; 28/266

[58] Field of Search ..... 19/157, 151, 240, 239, 19/300, 105, 0.46, 0.48, 0.56, 0.58, 0.60; 28/266

[56] References Cited

U.S. PATENT DOCUMENTS

| | | | |
|---|---|---|---|
| 1,893,050 | 1/1933 | Burhenne | 19/151 |
| 2,713,182 | 7/1955 | Bokum | 19/151 X |
| 3,108,352 | 10/1963 | Haigler et al. | 28/266 |
| 3,216,064 | 11/1965 | Kates | 19/157 X |
| 3,248,103 | 4/1966 | Tarbell | 19/157 X |
| 3,266,692 | 8/1966 | Whitten | 19/157 X |
| 3,887,969 | 6/1975 | Erickson et al. | 28/266 |
| 4,133,455 | 1/1979 | Moser | 19/105 X |
| 4,475,271 | 10/1984 | Lougren et al. | 19/105 |
| 4,574,433 | 3/1986 | Brunnschweiler | 19/240 X |

FOREIGN PATENT DOCUMENTS

| | | | |
|---|---|---|---|
| 0674899 | 11/1864 | Italy | 19/0.58 |

*Primary Examiner*—Louis K. Rimrodt

*Attorney, Agent, or Firm*—Sprung Horn Kramer & Woods

[57] ABSTRACT

An improved method for the after-treatment of washed and dried fibre cable having a minimum mass of 250 ktex by crimping, fixing, cooling and optionally cutting or tearing is achieved in that the band width of the cable issuing from the drier with a covering density of at most 5 ktex/cm is reduced by at least 50% of the original band width with a corresponding increase in the packing density, is crimped in a stuffer box crimping means at a stuffer box pressure of from 4 to 10 N/cm and a stuffer box temperature of from 80° to 95° C., the crimping is fixed in or immediately after the stuffer box, the cable is deposited on the surface of an air-permeable conveyor belt, air is blown or sucked there through fibre package or conveyor belt and the cable is then optionally supplied to a tearing converter or a cutting machine.

4 Claims, 3 Drawing Figures

METHOD FOR THE MULTI-STAGE FIBRE CABLES AND THE APPARATUS REQUIRED FOR IT

BACKGROUND OF THE INVENTION

Continuous threads (fibre cable) spun from solvents and combined to form bands of many individual filaments pass through a number of after-treatment stages before being conveyed into the secondary spinning mill, that is into the yarn production apparatus.

The essential stages are washing to remove residual solvent, drawing, drying, crimping, crimp fixing and cooling.

Whereas the threads are conveyed through the washing and drying units with minimal covering density, i.e. as a thin band which is as wide as possible, during the washing and drying treatment in order to achieve optimum results, i.e. high degree of washing and drying, it is advantageous to carry out crimping, crimp fixing and cooling with as little apparatus as possible and this leads to a saving in processing and investment costs and also to a product of uniform quality.

In the past, for example, a sliver of a certain width was divided into several narrow silvers after washing and drying and each sliver was crimped in an individual crimping chamber, with the crimping chambers being arranged not next to one another but displaced behind each other for reasons of space, and, owing to the varied dwelling times of the bands between dryer and crimping unit, allowing for irregularly crimped band portions. It is now desirable to use only one crimping apparatus for a certain cable thickness in the form of a wide band in order to improve the quality of the product, in particular a uniform quality with respect to crimping, transverse adhesion of the cable, attainable carding rate, feel and dye holding capacity, to mention only a few important parameters.

SUMMARY OF THE INVENTION

Starting from this consideration, an object has arisen for economic reasons of adapting the stages of the method and the necessary apparatus for the entire process to one another in such a way that a product of higher quality and with reduced deterioration is produced with a more economical mode of operation and reduced power requirement.

This can surprisingly be achieved if the fibre cable issuing from the dryer outlet is guided over an apparatus for reducing the band width optionally a steam unit, stuffer box crimping means, a cooling belt and optionally a cutting means or a tearing means while maintaining certain parameters in terms of method and apparatus.

The invention accordingly relates to a method for the after-treatment of washed and dried fibre cables having a minimum mass of 250 ktex by crimping, fixing, cooling and optionally cutting or tearing, characterised in that the band width of the cable issuing from the dryer with a covering density of at most 5 ktex/cm is reduced by at least 50% of the original band width with a corresponding increase in the packing density, the cable is crimped in a stuffer box crimping means at a chamber pressure of 1.5 $N/cm^2$ to 6.0 $N/cm^2$ and a stuffer box temperature of 80° to 95° C., the crimp is fixed in or immediately after the stuffer box, the cable is deposited on the surface of an air-permeable conveyor belt, air is blown or sucked there through the fibre package and the conveyor belt and the cable are then optionally supplied to a tearing converter or to a cutting machine.

The band width of the cable can be reduced by means of obliquely positioned rods over which the partial bands are guided. Novel and inventive displacement by means of rollers is preferably adopted.

The sliver of which the width is to be reduced is removed from the pick-up mechanism (a) in the form of at least two individual bands preferably of equal thickness, the individual bands are guided over separate rollers ($b_1$), ($b_2$) etc. and are superimposed on a roller (c) to form a band of reduced width, the axis of the roller (a) enclosing an angle of 1.5 to 7° with the axis of at least one of the rollers ($b_1$), ($b_2$) etc.

As the bands invariably meet each roller perpendicularly, the distance between the roller (a) on the one hand and the rollers ($b_1$), ($b_2$) etc. on the other hand results from said angle and the desired extent of band displacement.

The "displacement" of the slivers onto a common axis, which is at the same time the central axis of the crimping rollers, is achieved by pivoting the rollers (cylinders) $b_1$ and $b_2$, and the fact that there is only one possible guide axis for the sliver travel, more specifically the shortest distance from the three pick-up mechanisms via roller $b_1$ or $b_2$ to roller c, is utilized. Only this axis provides stable guidance whereas, with all other guide paths, lateral forces are produced in the sliver and remain effective until the stable axis is reached again. Now if the rollers $b_1$ and $b_2$ are adjusted about their pivot, the band travels around the same angular distance in the corresponding direction. During relative adjustment of the rollers, it is therefore possible to adjust the two bands precisely on one another and to the centre axis of the crimping apparatus.

The sliver is preferably halved in width, in other words is divided into two partial bands of equal width which are guided over rollers ($b_1$) and ($b_2$) and combined on the roller (c), the axes of the rollers ($b_1$) and ($b_2$) enclosing with the axis of the roller (a) an equally large but opposingly directed angle of from 1.5° to 7°, preferably from 2° to 5°.

With even smaller angles, the distance between the rollers ($b_1$) and ($b_2$) on one hand and the roller (a) on the other hand would be uneconomically large and with greater angles a perfect delivery of the slivers from the rollers would no longer be reliably guaranteed.

The invention also relates to an apparatus comprising a roller (a), at least two rollers ($b_1$), ($b_2$) etc. and a roller (c) as well as corresponding connecting members which bear the rollers, characterised in that the axis of the roller (a) encloses an angle $\alpha$ of from 1.5° to 7°, preferably from 2° to 5° with the axis of at least one of the rollers ($b_1$), ($b_2$) etc. and extent of displacement V, distance L between the roller (a) and the rollers ($b_1$), ($b_2$) etc. and the angle $\alpha$ are linked together by the following equation:

$$V = L \cdot \tan \alpha$$

Reference is made to FIG. 1 with respect to $\alpha$, V and L.

DETAILED DESCRIPTION OF THE INVENTION

Figure 1:
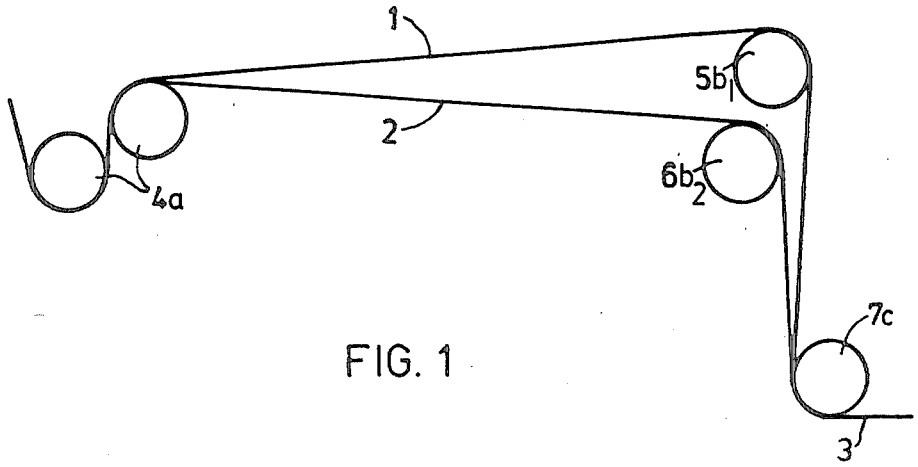
FIG. 1 is a side view sketch of the apparatus for displacing slivers according to the invention.

FIG. 1 shows a side view sketch of the apparatus for displacing the slivers wherein (1) and (2) are the bands to be displaced which produce the band (3) of reduced width. The bands (1) and (2) lie next to one another on the rollers a labelled (4) and (5) and (6) represent the rollers $b_1$ and $b_2$. (7) is the roller c.

Figure 2:
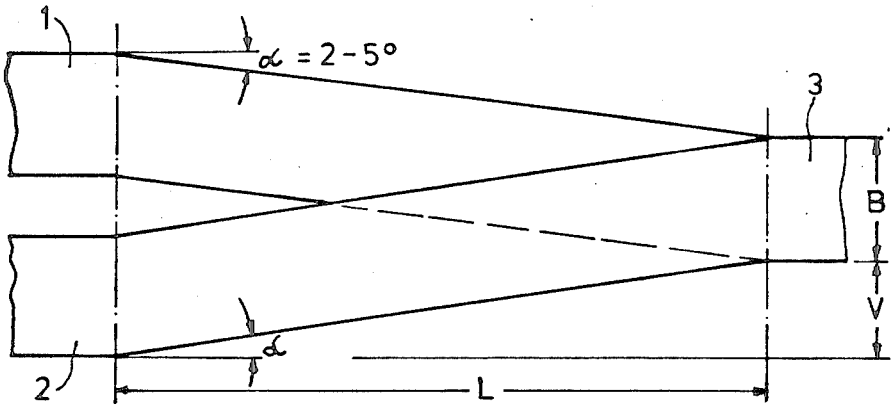
FIG. 2 is a plan view of the displacement of FIG. 1.

FIG. 2 shows a plan view of the cable displacement with the individual bands (1) and (2) and the resulting band (3) from which $\alpha$, L and V are derived.

Figure 3:
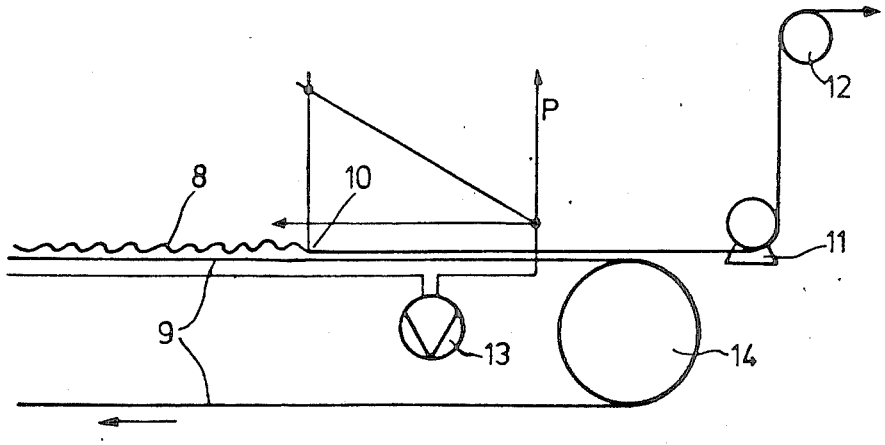
FIG. 3 is a sketch of the means for controlling the pickup of the crimped cake from the conveyor belt.

FIG. 3 shows a sketch of the means described below for controlling the pick-up of the crimped cake from the conveyor belt. The stacked crimped sliver (8) is unravelled on the conveyor belt (9) at point (10) to form a sliver which is supplied via the draft measuring instrument (11) and a further deflection means (12) to the cutting apparatus (not shown). The sliver is held under a low pressure, produced by the fan (13), on the conveyor belt which runs endlessly round the roller (14) and a corresponding roller (not shown) with a predetermined force, the change of which is sketched over the length of the drawn sliver in the figure.

Horizontally running perforated belt and metallic cloth belt coolers, in particular, which revolve at a speed of 5 to 40 m/min, are used for fixing and cooling the crimped cable. In particular, the sliver is folded and deposited on the cooling belt.

The silvers to be cooled are stacked on the conveyor belt with a covering density of from 10 to 15 kg/m$^2$.

The cooling capacity of a 10 m long and 40 cm wide cooling belt is up to 4000 kg/h of fibre material.

The air which is sucked or blown through the fibre package preferably has a temperature which is as low as possible, and in any case a temperature which lies below that of the sliver to be cooled. The air is preferably at ambient temperature.

The cooled cable preferably supplied to a cutting device of a suitable design. When supplying the cable to the cutting device it is necessary to convey the cable at a tension which is as constant as possible. The cutting device is preferably a rotor cutting device.

It has also been found that the thread tension of a thread cable of crimped threads, originating from a stacked fibre package, can be kept constant if the fibre package is conveyed on a revolving air-permeable conveyor belt, is exposed to vacuum on the conveyor belt and is then picked up by a driving mechanism, the fibre package previously passing through a tension measuring instrument and optionally further deflecting members and the tension measuring instrument comparing the actual thread tension with a predetermined set value, braking the driving mechanism when the set value is exceeded and accelerating it when the set value is not reached.

The invention also relates to an apparatus for keeping constant the thread tension of the thread cable originating from a stacked fibre package comprising (a) an air-permeable conveyor belt 9 with driving mechanism 14 and fan 13, (b) a tension measuring instrument 11 (c) a pick-up tension member with a driving mechanism 12, wherein the tension measuring instrument and driving mechanism are coupled together in such a way that the tension measuring instrument controls the driving mechanism and wherein the vacuum produced by the fan exerts a frictional force on the opened sliver 8.

The air-permeable conveyor belt 9 can at the same time act as a cooling belt for the crimped fibre package arriving from the crimping apparatus.

The fibre package is opened into a strand of crimped threads and is picked-up at a certain point by the driving gear of the pick-up member. The opened fibre cable is held inside the suction section with a force proportional to the vacuum, the sliver width and the sliver length of the opened sliver. If this force is equal to the set value determined in the tension measuring instrument, the drive of the pick-up member picks up the fibre cable at a uniform speed. If the force with which the differential pressure attempts to hold the fibre cable on the conveyor belt falls below the predetermined set value, the drive measuring instrument controls the driving of the pick-up member in such a way that the thread cable is picked-up at a higher speed. The point at which the fibre package is split is therefore displaced against the direction of thread travel on the conveyor belt. The length of the sliver therefore increases. The force with which the vacuum holds the sliver becomes greater, and exceeds the set value of the tension measuring instrument which then brakes the driving mechanism of the pick-up member. The braking of the take-up member causes the point at which the fibre package is opened into sliver to move in the direction of the thread travel so that the force exerted on the sliver by differential pressure is reduced because the slilver length becomes smaller.

With suitable adjustment of the tension measuring instrument, the point at which the fibre package is split into a silver can come to rest within a certain region, the point shifting only to an insignificant extent during operation.

EXAMPLE

Two slivers composed of polyacrylonitrile and having a respective individual titre of 200 ktex 3.3 dtex, lying next to one another in a width of 350 mm respectively were subjected to the treatment stages of washing, drawing and drying and were then removed from the drier by the three pick-up means a. A respective sliver was subsequently placed over the rollers $b_1$ and $b_2$ and thus displaced to the common axis of roller c. The two bands then looped the roller c in a superimposed manner and were subsequently supplied to the crimping apparatus.

The distance between the rollers a and b arranged at the same height was 4.5 m. Roller $b_2$ was mounted 40 cm above the extension of the horizontal through a and $b_1$ above a point located 40 cm from $b_1$. Roller c was mounted 80 cm below a point on the extension of horizontal through a and $b_1$ which was 20 cm from $b_1$. The angle $\alpha$ was 2.5°.

This resulted in a displacement factor V of 200 mm.

The slivers were heated to 90° to 95° C. by means of saturated steam before entering the stuffer box at 80 m/min. The crimping cylinder pressure was 600 N/cm, the box width 350 mm, the stuffer box pressure 5 N/cm$^2$. The crimped slivers left the crimping apparatus as a continuous package ("cake") having the stuffer box width and a height of about 20 mm and were supplied via a chute to the cooling and fixing apparatus. The fold factor (quotient of band entry speed into the crimping means and band outlet speed from the crimping means) of the cake was 1:10.

The "cake" was transferred by the conveyor belt of the cooling and fixing apparatus, the belt velocity being 12% greater than the velocity of the crimp cake pushed out of the crimping machine. The air permeability of the fibre package was thus improved. With a dwell time of about 1 minute, the fibre material attained ambient temperature (cooling air about 12,000 $m^3/h$) and was unravelled again to the drawn band length. A tensile strength of 4 N/ktex built up in the band during this process, at which tensile strength it was supplied to a rotary cutting device which cut the material into staple fibres at a velocity of about b 68 m/min. The jaw width of the blade ring was 80 mm, the cutter ring diameter about 1200 mm. In further treatment stages, the cut material was further steamed and then packaged.

Practical testing of the fibre material produced the following results:

| | |
|---|---|
| Crimping | 10% |
| Residual crimping | 6.5% |
| Resistance | 42% |
| Number of bends | 34 per 10 cm |
| Average staple length | 55 mm |
| Yarn boiling shrinkage | 2% |
| Adhering power | 72 cN/ktex |
| Maximum carding speed | 120 m/min |

We claim:

1. In a method for the after-treatment of washed and dried fibre cables having a minimum mass of 250 ktex by crimping, fixing, cooling and optionally cutting or tearing, the improvement wherein the band width of the dried cable with a covering density of at most 5 ktex/cm is reduced by at least 50% of the original band width by dividing the original cable into at least two individual bands and packing the bands one over the other to obtain a corresponding increase in the packing density is crimped in a stuffer box crimping means at a stuffer box pressure of from 1.5 to 6N/$cm^2$ and a stuffer box temperature of from 80° to 95° C., the crimping is fixed in or immediately after the stuffer box, the cable is deposited on the surface of an air-permeable conveyor belt, air is blown or sucked through the fibre package and conveyor belt and the cable is then optionally supplied to a tear converter or a cutting machine.

2. A method according to claim 1, wherein the bank width is reduced by taking the sliver which is to be reduced in width from a first roller in the form of at least two individual bands, guiding the individual bands over separate rollers and superimposing same on a further roller to form a band, wherein the axis of the first roller (a) encloses an angle of from 1.5° to 7° with the axis of at least one of the separate rollers.

3. A method according to claim 1, wherein the fibre cable is supplied with constant tension by conveying the fibre cable on a revolving air-permeable conveyor belt, exposing the cable on the conveyor belt to a vacuum to apply a force on the cable, measuring the cable tension within a tension measuring instrument and subsequently driving the cable with a driving mechanism by comparing the tension with a predetermined value and braking the driving mechanism when the value is exceeded and accelerating the driving mechanism when the measured value is below the set value.

4. In an apparatus for reducing the band width of fibre cable from a first roller, the improvement comprising: means for splitting the cable into bands and guiding same on at least two second rollers means for superimposing the bands on a third roller, wherein the axis of the first roller encloses an angle of from 1.5° to 7° with the axis of at least one of the second rollers and the extent of displacement V, distance L between the first roller (a) and the second rollers and the angle $\alpha$ are linked together by the following equation $$V = L \cdot \tan \alpha.$$

* * * * *